US005558807A

United States Patent [19]

Kim

[11] Patent Number: 5,558,807

[45] Date of Patent: Sep. 24, 1996

[54] WAX ISOMERATE-BASED HIGH TEMPERATURE LONG BEARING LIFE GREASE

[75] Inventor: Jeenok T. Kim, Holmdel, N.J.

[73] Assignee: Exxon Research and Engineering Company, Florham Park, N.J.

[21] Appl. No.: 445,035

[22] Filed: May 19, 1995

[51] Int. Cl.[6] ..... C10M 105/00; C10M 133/00

[52] U.S. Cl. ..... 508/251; 508/261; 508/518

[58] Field of Search ..... 252/41, 50, 38

[56] References Cited

U.S. PATENT DOCUMENTS

| | | | |
|---|---|---|---|
| 3,711,407 | 1/1973 | Plumstead | 252/41 |
| 3,929,651 | 12/1975 | Murray et al. | 252/41 |
| 4,075,112 | 2/1978 | Van Doorne | 252/35 |
| 4,075,113 | 2/1978 | Van Doorne | 252/35 |
| 4,406,800 | 9/1983 | Christian | 252/28 |
| 4,749,502 | 6/1988 | Alexander et al. | 252/35 |
| 5,059,299 | 10/1991 | Cody et al. | 208/27 |
| 5,158,671 | 10/1992 | Cody et al. | 208/264 |

FOREIGN PATENT DOCUMENTS

| | | |
|---|---|---|
| 084910 | 8/1983 | European Pat. Off. . |
| 9109595 | 6/1984 | Japan . |

*Primary Examiner*—Prince Willis, Jr.
*Assistant Examiner*—Cephia D. Toomer
*Attorney, Agent, or Firm*—Joseph J. Allocca

[57] ABSTRACT

A high temperature long bearing life grease is disclosed comprising a wax isomerate based base stock plus an antioxidant consisting of a metal salt and a diphenyl amine. The base stock may be 100% wax isomerate oil or mixture of wax isomerate oil and mineral oil boiling in the lube oil boiling range.

6 Claims, No Drawings

WAX ISOMERATE-BASED HIGH TEMPERATURE LONG BEARING LIFE GREASE

BACKGROUND OF THE INVENTION

1. Field of the Invention

This invention relates to totally or partially synthetic bearing greases containing thickeners and antioxidants among other additives for sealed-for-life application or long turnaround time lubrication under high temperature, high speed and severely oxidative conditions.

2. Description of the Related Art

Long term lubrication of modern bearings requires greases which stand up well to high temperatures and oxidizing environments. Lubricant performance is especially severely tested in sealed for life applications, where lubricant replacement is not contemplated and lubricant wear or breakdown will not be appreciated until after bearing failure.

The lubricating industry has turned to synthetic base stocks such as polyalpha olefins and polyol ester base stocks for grease formulations.

U.S. Pat. No. 4,406,800 discloses a grease useful over a wide temperature range comprising a polyalpha olefin base fluid and a thickener.

U.S. Pat. No. 4,075,112 and U.S. Pat. No. 4,075,113 disclose grease compositions comprising 2–15 wt % aluminum soap, 25 to 97 wt % of a hydrogenated or non-hydrogenated polymer of a monoolefin hydrocarbon having 4 carbon atoms and a mean molecular weight of between 300 and 2500, and 0–60 wt % of a lubricating oil which is preferably a mineral oil.

Japanese Patent Publication 55-9109595 discloses a lithium soap which may include a refined base stock derived from naphthenic, paraffinic and mixed base crudes. Synthetic lubricating oils are also disclosed as being useful. These include polymers and copolymers of alpha-olefins.

U.S. Pat. No. 4,749,502 discloses a grease composition comprising an oil component having a major amount of a synthetic fluid having a viscosity of at least 50 cSt at 40° C. and a minor amount of a mineral oil having a pour point below −20° C. and a thickener. The synthetic fluid component is selected from polyolefins, esters, diesters, polyol esters, polyesters, high VI isoparaffins and mixtures thereof, preferably polyalpha-olefins. The high VI isoparaffins are described as those materials produced by hydrocracking or hydroisomerization of waxes. The thickeners are typically simple calcium, lithium, aluminum and/or barium soap of a fatty acid, such as stearic or 12-hydroxy stearic acid or the complex calcium, lithium, barium and/or aluminum soaps/salts of the fatty acids with lower molecular weight mono or diacid (e.g., azelaic) or benzoic acid, or a modified clay thickener. The greases also contain an additive package comprising an extreme pressure additive, an anti-wear additive, an anti-rust additive and an antioxidant. Preferred antioxidants are PANA, alkyl substituted aromatic amines, etc.

U.S. Pat. No. 5,059,299 and U.S. Pat. No. 5,158,671 teach a method for isomerizing waxes to lube base oils and a method for stabilizing said hydroisomerates, respectively. The patent recites that the hydroisomerates made are usable as lube base stocks and blending stocks. The isomerates are made by hydroisomerizing slack waxes secured by the solvent dewaxing of lubricating oil boiling range base stocks, e.g. 600N oil.

It would be desirable if a grease capable of performing for extended period of time at high temperatures/speeds and in an oxidizing environment could be formulated to exceed the performance of mineral oil-based greases yet at lower cost than polyalpha olefins or polyol ester-based greases.

SUMMARY OF THE INVENTION

The present invention is directed to a grease composition comprising:

(a) a major portion of a wax isomerate oil having a viscosity in the range 5 to 6.5 cSt @ 100° C. or a mixture of such wax isomerate and mineral oil and minor portions of (b) a thickener, (c) an antioxidant selected from the group consisting of alkylated diphenyl amine, phenothiazine, and substituted or unsubstituted quinoline, and, optionally (d) metal salt of salicylic acid.

The oil component of the grease composition is a wax isomerate oil-based stock. As used herein and in the claims the term wax isomerate oil-based stock means base stocks which comprise either 100% wax isomerate oil or a mixture of wax isomerate oil and mineral oil. The wax isomerate oil is characterized as having a viscosity of less than 50 cSt at 40° C., preferably less than 40 cSt at 40° C., most preferably 30 or less cSt at 40° C. (about 5.6 to 6.1 cSt at 100° C.). The wax isomerate oil is also characterized as having a viscosity index of at least 130, preferably at least 135, more preferably at least 140, most preferably 140 and higher. The wax isomerate oil is typically produced by the hydro-isomerization of natural or synthetic waxes. Natural waxes are preferably the slack wax recovered by the solvent dewaxing of mineral oils, e.g. slack wax recovered by solvent dewaxing 600N or bright stock. Synthetic wax is typically the wax produced by the Fischer Tropsch process.

The production of wax isomerate oil meeting the requirements of the present invention is disclosed and claimed in U.S. Pat. No. 5,059,299 and U.S. Pat. No. 5,158,671.

These wax isomerate oil can be used as the exclusive base stock for the formulated grease of the present invention. Alternatively, the grease base stock can comprise a mixture of the wax isomerate oil previously described with a mineral oil fraction. The mixture can contain wax isomerate oil/mineral oil in a weight ratio in the range 30:70 to 80:20, preferably 40:60 to 70:30, most preferably 45:55 to 60:40.

The mineral oil used in the invention is characterized as that fraction boiling in the lube oil boiling range 300° to 700° C., preferably 400° to 600° C., having a viscosity of in the range 6 to 30 cSt @ 100° C., preferably 8 to 20 cSt @ 100° C., most preferably 10 to 15 cSt at 100° C., a viscosity index of at least about 85, preferably at least about 90 most preferably 95 or higher and a pourpoint of about −9° C. and lower, preferably −15° C. and lower.

The wax isomerate-based base stock is combined with a thickener in an amount in the range 10 to 30 wt %, preferably 15 to 25 wt %.

Thickeners include the lithium soap of a fatty acid such as stearic acid or 12-hydroxystearic acid or the complex lithium soaps/salts of the fatty acids with lower molecular weight mono- or dibasic acids such as azelaic or benzoic acid. Complex lithium greases are preferred over the complex sodium or calcium greases in that the complex lithium greases exhibit better overall performance in oxidative and thermal stability, worked stability, least oil separation tendency and better water resistance than the complex sodium or calcium greases. This makes them the greases of choice for high temperature antifrictional bearing greases requiring long service life.

The grease also contains an antioxidant. Antioxidants for use in the present invention are selected from the group consisting of alkylated diphenyl amines where the alkyl group(s) contain(s) from 1 to 12 carbon atoms preferably 7 to 9 carbon atoms, unsubstituted phenothiazine and substituted and unsubstituted quinolines where the substituents are alkyl groups of 1 to 10 carbon atoms, preferably 1 to 5 carbon atoms and mixtures thereof preferably alkylated diphenyl amines. The antioxidant is used in an amount in the range 0.1 to 2 wt %, preferably 0.3 to 1.5 wt %, most preferably 0.5 to 1 wt %. Optionally, and preferably, the grease also contains a metal salt e.g. lithium, sodium, calcium salt of salicylic acid, preferably the lithium salt of salicylic acid, most preferably dilithium salicylate. This metal salt of salicylic acid is used in an amount in the range 0 to 5 wt %, preferably 1 to 4 wt %, most preferably 2 to 3 wt %.

The invention is further described in the following non-limiting examples.

EXAMPLE 1

Solvent Neutral (SN)600, oil wax isomerate oil made from 600SN slack wax in accordance with U.S. Pat. Nos. 5,059,299 and 5,158,671, and PAO (see Table 1 for viscosity data) were used as base oils to formulate complex lithium soap greases containing 13–18 wt % lithium soap additized only with 0.5 wt % octylated diphenyl amine antioxidant. The lithium complex soap thickeners for these greases were made with 9–13% 12 hydroxy stearic acid, 1.8–2.4% azelaic acid and 2.1–2.8% Li OH mono-hydrate. These complex lithium greases were evaluated in high pressure differential scanning calorimetry (HPDSC) oxidation test operated at 190° C. and 500 psi $O_2$, and in ASTM D3336 high temperature bearing test at 163° C. (see Table 2). As indicated by the induction time, which marks the onset of accelerated oxidative breakdown, the wax isomerate-based grease shows superior oxidation stability compared to the SN600 and PAO based greases. Moreover, the wax isomerate grease provides 250% improvement in D3336 bearing life measured at 163° C. over the mineral oil grease and comparable performance to the PAO grease.

TABLE 1

| | Base Oil Viscosity Data | | |
|---|---|---|---|
| | Solvent Neutral 600 | Wax Isomerate | PAO |
| Viscosity @ 40° C. (cSt) | 113 | 29.6 | 45.8 |
| Viscosity @ 100° C. (cSt) | 12 | 5.8 | 7.8 |
| VI | 95 | 142 | 138 |

TABLE 2

| Oxidation Stability and Bearing Life Performance Of SN600, Wax Isomerate and PAO Greases | | |
|---|---|---|
| Base Oil | HPDSC Induction Time (minutes) | D3336 Bearing Life @ 163° C. (hours) |
| SN600 | 3 | 120 |
| Wax isomerate | 21 | 300 |
| PAO | 8 | 450 |

EXAMPLE 2

Complex lithium greases made with polyol ester base stock, SN600 oil base stock, and a 50/50 mixture of SN600 oil and the wax isomerate oil recited in Example 1 were evaluated for bearing life performance. The complex lithium grease made with the 50:50 mixture of the wax isomerate oil and SN600 effected a 225% increase in bearing life at 177° C. over the SN600 grease and almost equivalent performance to the polyol ester-based grease. The greases of this Example contain 0.5 wt % octylated diphenyl amine anti oxidant, 3% dilithium salicylate and 15–20 wt % complex lithium soap made with 10.7–14.3% 12-hydroxy stearic acid, 2–2.6% azelaic acid and 2.3–3.1% Li OH monohydrate.

TABLE 3

| High Temperature Bearing Life Performance of Greases Made With SN600, Mixed EXXSYN/SN600 and Polyol Ester | |
|---|---|
| Base Oil | D3336 Bearing Life at 177° C. (hours) |
| SN600 | 240 |
| SN600 + Wax Isomerate Oil | 540 |
| Polyol Ester | 600 |

EXAMPLE 3

A number of greases employing polyol ester base stock, SN600 base stock, wax isomerate oil base stock (of Example 1) and a 50/50 mixture of SN600 and wax isomerate oil were formulated using 15–20 wt % lithium soap thickener and 0.5 wt % of various antioxidants. Three of the formulations contained dilithium salicylate (DLS) as secondary antioxidant. The grease formulations and their performance (oxidation stability) measured in terms of HPDSC induction time are reported in Table 4 below.

TABLE 4

| Base Oil | Soap | DLS | HPDSC (Temp °C.) | 1 | 2 | 3 | 4 | 5 | 6 |
|---|---|---|---|---|---|---|---|---|---|
| SN600[a] | Complex Li | 3 wt % | 200 | 80 | 20 | 6 | 33 | 28 | 17 |
| Polyol Ester[b] | Complex Li | 3 wt % | 220 | 40 | 24 | 47 | 15 | 11 | 33 |
| Isomerate | Complex Li | — | 190 | 25 | 23 | 20 | — | — | 12 |
| Isomerate/ SN600[c] | Complex Li | 3 wt % | 200 | 35 | 21 | — | — | — | — |

1 octylated diphenyl amine
2 phenothiazine
3 cyclic amine (1,2 dihydro 2,2,4-trimethyl quinoline)
4 Phenyl-alpha-naphthyl amine
5 secondary amine
6 Bis (phenylamine) methane
[a], [b] and [c]correspond to the materials reported in Example 2, Table 3

It is seen that for the complex lithium greases containing DLS as a secondary oxidation inhibitor, the octylated diphenyl amine is the most effective anti-oxidant regardless of base oil used. However, when both oxidation stability and high temperature bearing life performance are considered, reference to Tables 2, 3 and 4 reveals that the greases made using wax isomerate or SN600/wax isomerate mixture base stocks are the unexpectedly superior formulations.

What is claimed is:

1. A grease composition comprising a major portion of a wax isomerate oil based base stock, a lithium soap thickener or a complex lithium soap thickener present in an amount in the range of 10 to 30 wt %, an antioxidant selected from the group consisting of alkylated diphenyl amine, phenothiazine and substituted and unsubstituted quinoline in an amount in the range 0.1 to 2 wt % and a metal salt of salicylic acid present in an amount in the range 0 to 5 wt %.

2. The grease composition of claim 1 wherein the wax isomerate oil based base stock is 100% wax isomerate oil having a viscosity in the range 5 to 6.5 cSt @ 100° C.

3. The grease composition of claim 1 wherein the wax isomerate oil based base stock is a mixture of wax isomerate oil having a viscosity in the range 5 to 6.5 cSt @ 100° C. and mineral oil in a wax isomerate oil/mineral oil weight ratio in the range 30:70 to 80:20.

4. The grease composition of claim 3 wherein the mineral oil component of the mixture of wax isomerate oil and mineral oil is the mineral oil fraction boiling in the range 300° to 700° C. and having a viscosity in the range 6 to 30 cSt @ 100° C. and a viscosity index of at least about 85 and a pour point of about −9° C. and lower.

5. The grease composition of claim 1, 2, 3 or 4 wherein the metal salt of salicylic acid is the lithium salt.

6. The grease composition of claim 5 wherein the lithium salt of salicylic acid is dilithium salicylate.

* * * * *